United States Patent [19]

Houpt et al.

[11] 4,410,774

[45] Oct. 18, 1983

[54] SINGLE KNOB VARIABLE RANGE TIMER

[75] Inventors: Grover K. Houpt, Wayne; George F. Updegrove, Spring City, both of Pa.

[73] Assignee: American Manufacturing Company, Inc., King of Prussia, Pa.

[21] Appl. No.: 387,220

[22] Filed: Jun. 10, 1982

[51] Int. Cl.[3] ..... H01H 19/54; H01H 7/08

[52] U.S. Cl. ..... 200/14; 200/38 B; 200/38 E; 200/37 A; 368/107

[58] Field of Search ..... 368/107–113; 307/141, 141.4, ; 200/38 A, 38 F, 38 FA, 38 B, 38 C, 14, 37, 38 E

[56] References Cited

U.S. PATENT DOCUMENTS

| | | | |
|---|---|---|---|
| 2,825,772 | 3/1958 | Jones | 200/37 A |
| 3,465,269 | 9/1967 | Hendershot | 200/38 E |
| 3,582,582 | 1/1971 | Pauker et al. | 200/38 B |
| 4,146,758 | 3/1979 | Hiwatahi et al. | 200/14 X |

*Primary Examiner*—J. V. Truhe

*Assistant Examiner*—Terrance L. Flower

*Attorney, Agent, or Firm*—Nelson E. Kimmelman

[57] ABSTRACT

A timer has a single knob which is normally used to set a desired timing cycle within a given range and also, when pulled out, to set a selected one of a plurality of ranges. When the knob is pulled out, projections formed on the control shaft engage a concentrically-mounted rotatable disc having at least one set of peripheral teeth. These teeth engage a flexible plastic detent formed in the front of the plastic housing of the timer. The rotatable disc is coupled to a reciprocating slider having conductive fingers which engage predetermined pairs of conductive contacts on a circuit board. As the disc rotates and the slider fingers touch different pairs of contacts, different circuit components are actuated thereby changing the range. In one variation of the timer, means are provided for changing the visible decimal point on the dial to correspond to the range selected.

24 Claims, 12 Drawing Figures

SINGLE KNOB VARIABLE RANGE TIMER

BACKGROUND OF THE INVENTION

A. Field of the Invention

This invention relates to electrical timing apparatus or the like and, in particular, to an all-electronic timing device in which both the timing cycle and the choice of several timing ranges is accomplished with a single knob.

B. Prior Art

In the past, timers having multi-range features, such as the Model 328 Timer marketed by the Automatic Timing & Controls Company of King of Prussia, Pa., employed two knobs for controlling, respectively, the range and the length of the timing cycle within a specified range.

To the extent that there was sufficient room to position the two knobs of the two-knob timers so that they were easy to manipulate manually, two-knob timers were useful. However, it is sometimes desired to make a small timer, such as the present timer, in which case placement and normal manipulation of two knobs is very difficult. Also, even without that disadvantage, two-knob timers are often more expensive to manufacture than a single knob timer as taught in the present invention.

Other available timers had a dial for indicating the progress of the timing cycle and a screw driver adjustment by which an operator of a process could change the range. With this kind of timer, while it was possible to change the range and show what that range was, the dial on which the timing indicia appeared remained unchanged. Thus, it was necessary to make a mental interpolation for proper placement of the decimal point on the dial when a range was brought into play which was a multiple or submultiple of the range for which the dial was meant to be read directly.

It is therefore among the objects of the present invention to provide:

1. A single-knob timing apparatus in which manipulation of the knob changes both the range and the length of a particular timing cycle.

2. A timer having a single knob for (a) allowing selection of a particular timing cycle (b) selection of the range and (c) simultaneously changing the dial presentation to accord with the range chosen.

3. A timer which may be made smaller because it has a single knob used to perform a plurality of functions.

4. A timer which is less expensive to manufacture than many other known timers.

5. Apparatus having a single knob which, depending upon its axial position, can control a plurality of operations as a function of its axial position.

6. Apparatus having a single knob which, in addition to performing a number of operations as a function of its axial position, can simultaneously present a visual indication of each function being performed.

SUMMARY OF THE INVENTION

Control or indicating apparatus such as timers which comprise first rotatable means adapted to be coupled to a first rotatable utilization apparatus for controlling the latter in a first predetermined axial position, and second rotatable means coupled to second utilization apparatus and being adapted to cooperate with the first rotatable means when the latter is in a second predetermined axial position to control the second utilization apparatus.

In another embodiment, means are provided for providing visual indications of differing decimal points as a function of rotation of said second rotatable means.

DETAILED DESCRIPTION OF THE DRAWINGS

Figures 1, 2, 3, 4, 5:
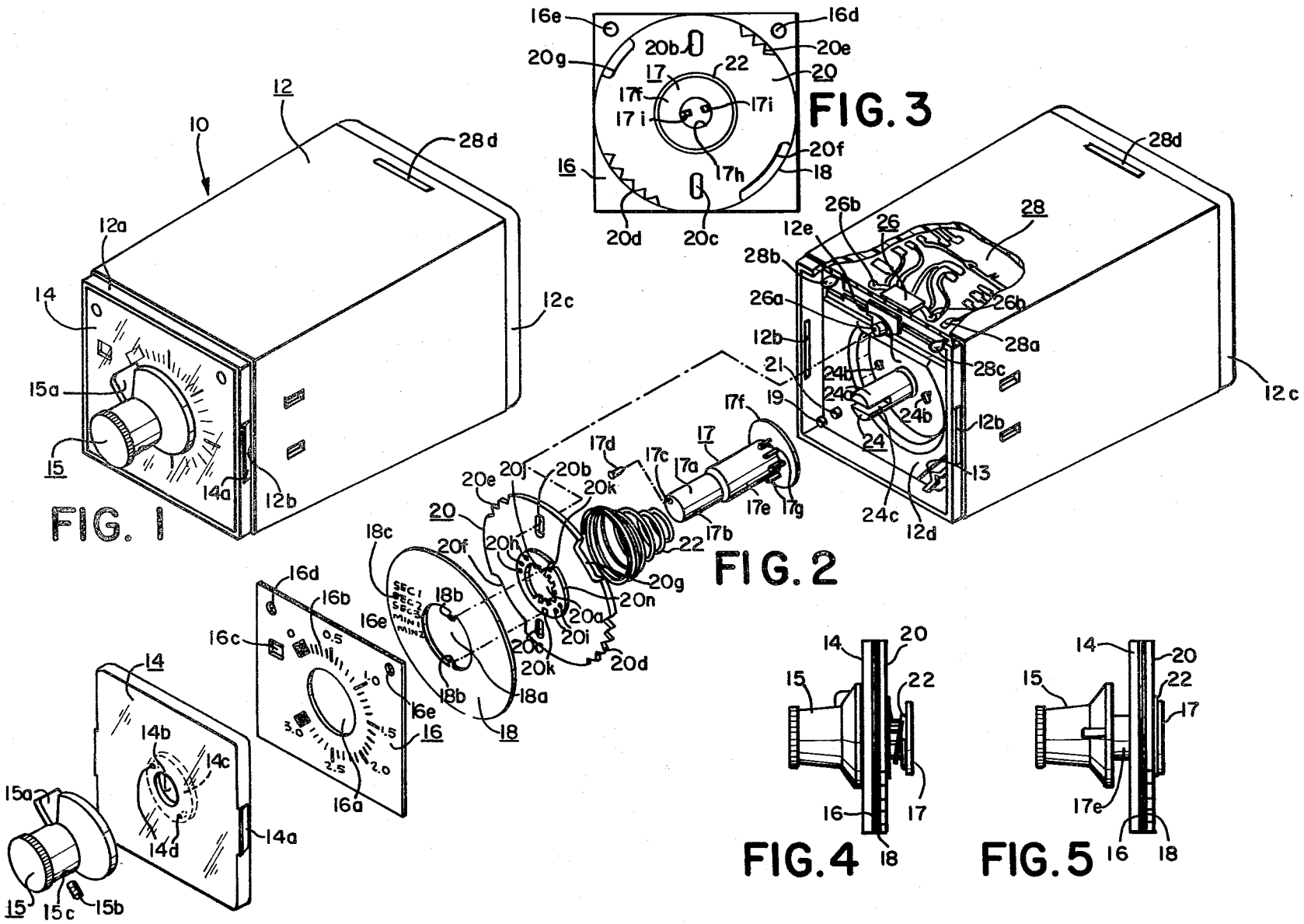
FIG. 1 is a perspective view of the outside of the apparatus of the type described herein.
FIG. 2 is an exploded, partly broken-away perspective view of the principal components of the apparatus shown in FIG. 1 according to one form of the present invention.
FIG. 3 is a view taken from the rear of several of the components of the apparatus shown in FIG. 2.
FIG. 4 is a side elevation view of the knob and related subassembly shown in FIG. 2 when in its normal position.
FIG. 5 is a side elevation view of the subassembly shown in FIG. 4 when the knob has been turned and pulled outwardly to its range setting position.

Referring to FIGS. 1–10, there is shown a timer indicated generally at the numeral 10 comprising a slightly tapered plastic housing 12 having a slightly smaller front portion **12*a* in which slots 12*b* are formed on the sides opposite one another. A single knob 15 having a pointer 15*a* is attached to the outer end of a control shaft indicated generally at 17 whose front section 17*a* protrudes through the spring 22, the central aperture 20*a* of the toothed rotary member 20, the central aperture 18*a* of the indicia-bearing disc 18, the central aperture 16*a* of the timing cycle plate 16 and the central aperture 14*b* of the transparent planar member 14. The knob is affixed to the end of the control shaft by a set screw 15*b* that passes through a threaded aperture 15*c* and engages the aperture 17*b* formed in control shaft 17**.

The transparent plate 14 has a central recess **14*c* on its rear surface to accommodate the boss 20*n* of disc 20. It also has bevelled ears 14*a* which, when the plate is pressed into the front 12*a*, snap in to engage the slots 12*b* therein to lock the plate into place. Between the plate 14 and the apertured partition wall 12*d* which is integrally formed in the housing 12, the members 16, 18, 20, 22 and 17 are axially aligned. The plate 16 bears timing cycle data 16b as well as a window 16c which aligns with one of the range indicia 18c on the annular disc 18. Plate 16 also has two holes 16d and 16e which are aligned with lights 28b and 28c respectively that protrude through the irregularly-shaped opening 12e formed in the partition 12d**.

The annular disc 18 is brought into proper register with the toothed range setting disc 20 by means of two tabs 18b, formed at the periphery of the inner aperture 18a, that engage notches 20k formed in the boss 20n thereof.

The toothed wheel 20 has one set of five teeth 20d and, substantially diametrically opposed, a second set 20e of three teeth. In the rotational orientation of the range setting disc 20 as shown, the flexible plastic detent 13 formed in the housing 12 will engage a particular space in the set 20d. If the disc 20 is rotated approximately 180°, the detent 13 would engage one of the three teeth 20e. As may be seen, there is a slot 20b formed in disc 20 which slips over the protuberance 26a of the reciprocating, range-setting member 26. Member 26 is integrally made of plastic, but has affixed to it two resilient conductive fingers 26b that are disposed to engage a selected pair of conductive terminals formed on the upper surface of a circuit board 28.

When the knob 15 is pulled and simultaneously turned, the disc 20 is also turned, in a manner to be explained below, either clockwise or counterclockwise. The movement of slot 20b correspondingly moves the reciprocating member 26 to the right or the left for engagement of its fingers with different pairs of contacts 28a which bring in respectively different circuit elements for changing time ranges. The notches 20f and 20g formed in the perimeter of the rotating member 20 are disposed substantially diametrically opposite one another and are disposed to cooperate with the stop-pin 21 integrally formed and protruding from partition wall 12d. When the rotatable disc 20 is in the position shown, the stop pin 21 allows it to be turned for engagement only through an arc in which detent 13 can engage one of the set of five teeth 20d. However, if only three ranges are desired, the member 20 can be taken out, rotated 180° and then replaced so that it is the elongated slot 20c, rather than slot 20d, which engages the protuberance 26a of the sliding contact member 26. Then, it is the notch 20g which is limited by stop-member 21 and the disc 20 is permitted to move through an arc sufficient to permit detent 13 to engage the second set of teeth 20e.

As shown in FIG. 4, the spring 22 normally urges the knob 15-control shaft 17 to the right. In that case, the two projections 17i formed on the bore 17h (FIG. 3) normally engage the end slit 24c formed in the shaft 24a of a potentiometer 24 which protrudes through an aperture in the recessed portion 12e of the partition 12d. Ears 24b, which aline the body of the potentiometer, protrude outwardly through vertical slits formed in the portion 12e. Thus, normally, circular movement of the knob 15 causes corresponding rotation of the control shaft 17 and of the shaft 24a of the potentiometer which is in circuit with the particular subcircuit that determines the *length* of the timing cycle.

Figure 6:
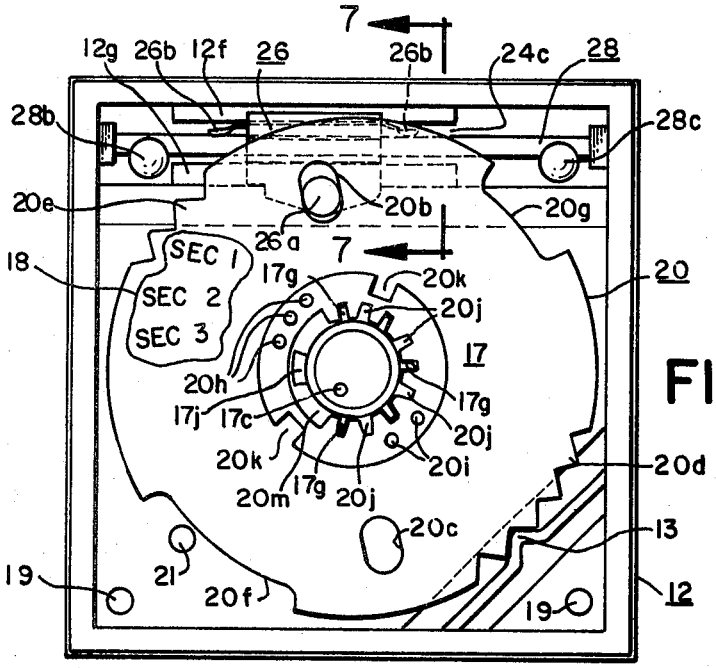
FIG. 6 is a front elevation view of some of the elements shown in FIG. 2 when the knob has been set so that range indicia "SEC 2" appears to the view through the window of the dial.
Figure 7:
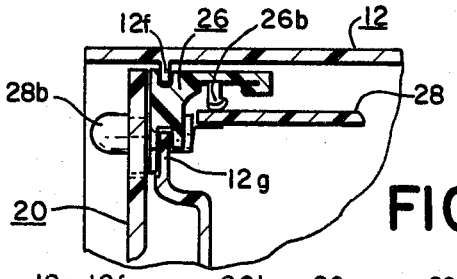
FIG. 7 is a sectional view taken along the section line 7—7 of FIG. 6.
Figure 8:
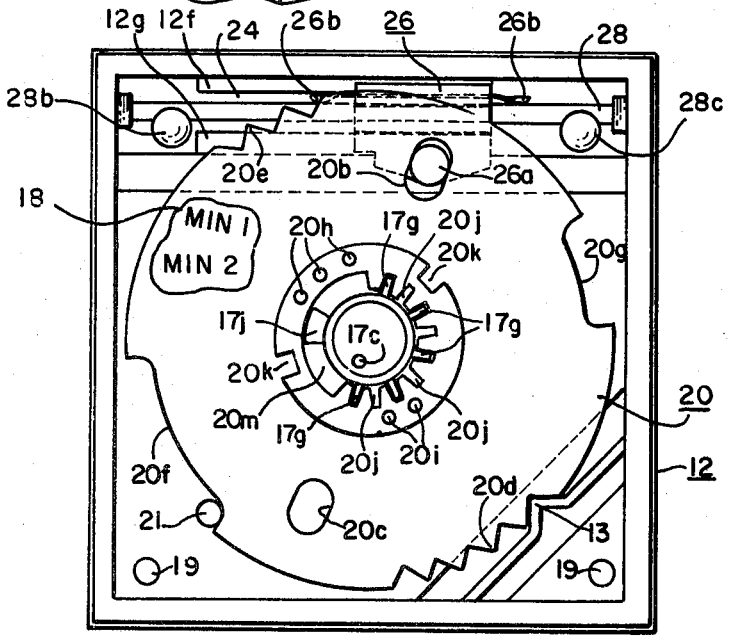
FIG. 8 is a front elevation view showing some of the elements of FIG. 2 when the knob has been set so that the range indicia "MIN 2" appears at the window of the dial.
Figure 9:
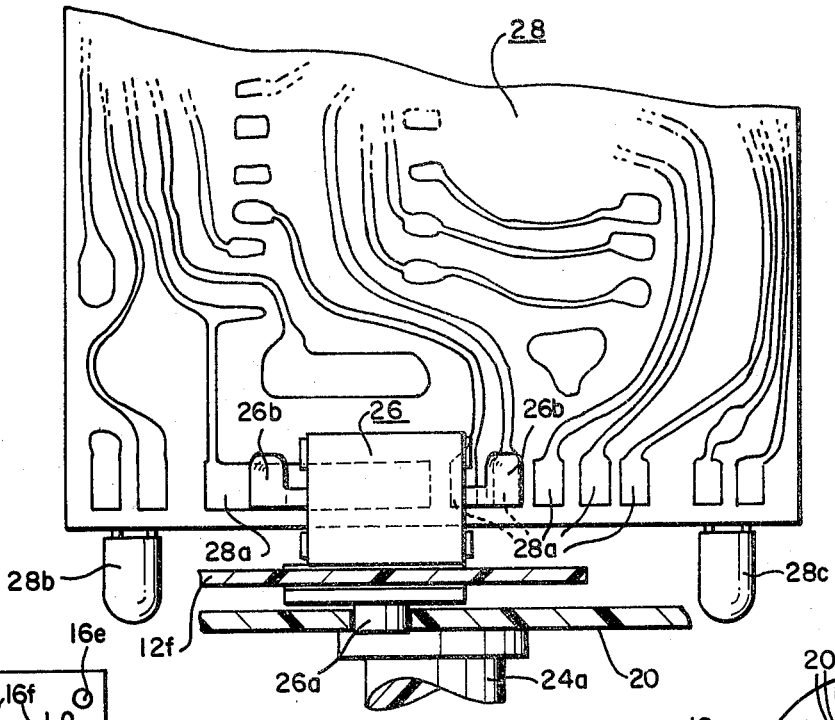
FIG. 9 is a fragmentary plan view, partly sectional, corresponding to the apparatus as shown in FIG. 6.

However, if it is desired to change the *range* from one of the "SEC" ranges to one of the "MIN" ranges, for example, the pointer 15a of the knob 15 is turned until it is at a mid-cycle reading, e.g., at 1.5 and then the knob is pulled out. This rotation alines the projections 17g with the crenelations 20j at the inner perimeter of aperture 20a so that they can be pulled into mutual engagement. The larger projection 17j on the outside of shaft 17 prevents engagement of the projections 17g with crenelation 20j until projection 17j can go into the space 20m. Actually, the space 20m is wide enough to permit one of the projections 17g on either end of the cluster to enter it together with larger projection 17j thereby permitting more latitude in the point on the dial at which the range setting may be made. Then, while still pulling the knob 15 as it is simultaneously rotated (FIG. 3), the teeth 20d pass the flexible detent 13 causing a series of clicks. For example, if the detent 13 originally was in the fourth one of the teeth 20d as shown in FIG. 6, the timer would be in the "SEC 2" range. If it were then desired to move it to the range "MIN 2", the knob 15 would be rotated clockwise until three clicks were heard whereupon the flexible detent 13 would engage the first tooth as shown in FIG. 8. As the rotatable plastic disc 20 is rotated clockwise, its elongated slot 20b which engages the protuberance 26a is also moving clockwise thereby causing the reciprocating contact subassembly 26 to move to the right. In so doing, the metallic conducting members 26b would also move from the position shown in FIG. 6 to the right thereby contacting different pairs of contacts 28a on the upper surface of the printed circuit board 28 toward its front edge as shown in FIG. 8.

When the range has been set, the knob is released so that, under the bias of spring 22, the knob 15 and the control shaft 17 are moved toward the right (FIG. 4) with the projections 17i in the bore 17h of the shaft 17 still continuing to engage the slit 24c of the potentiometer 24. Since the shaft 17 moves to the right, its external longitudinal projections 17g move out of engagement with the crenelations 20j of the rotatable member 20 and, therefore, further rotary movement of the shaft 17 as a result of turning of the knob 15 does not rotate member 20 and disc 18. Thus, the length of the cycle may then be set without disturbing the range setting by turning the knob 15 until the pointer 15a is at the desired setting on the cycle indicia 16b.

In operation of this device, it is often desirable to lock in the range setting to prevent inadvertent changes thereof. This may be accomplished by the use of the pin 17d which is initially stored in an aperture 17c in the end of the control shaft 17. By loosening the set screw 15b of knob 15, the knob may be slipped off the end of the shaft 17 thereby exposing the pin within its aperture. Removal of the pin may then be effected and the pin may then be passed through any one of the desired holes 14d which align with corresponding holes 20h and 20i. By so doing, the rotatable disc 20 is prevented from rotary movement relative to the transparent plate 14 which is fixed into position in the front section 12a of the housing of the timer.

FIGS. 11 AND 12

Figure 11:
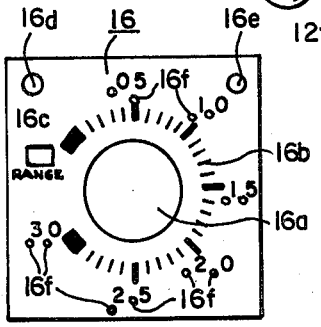
FIG. 11 is a front view of a modification of one of the elements in the apparatus shown in FIG. 2.
Figure 12:
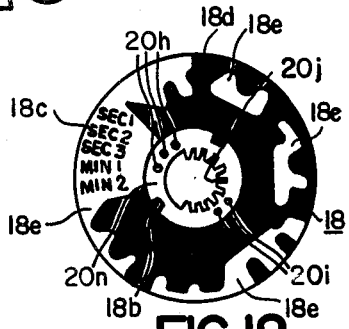
FIG. 12 is a front view of a modification of another one of the elements shown in FIG. 2 designed to cooperate with the element shown in FIG. 11 to present a direct visual indication of the decimal point corresponding to the selected range.
Figure 10:
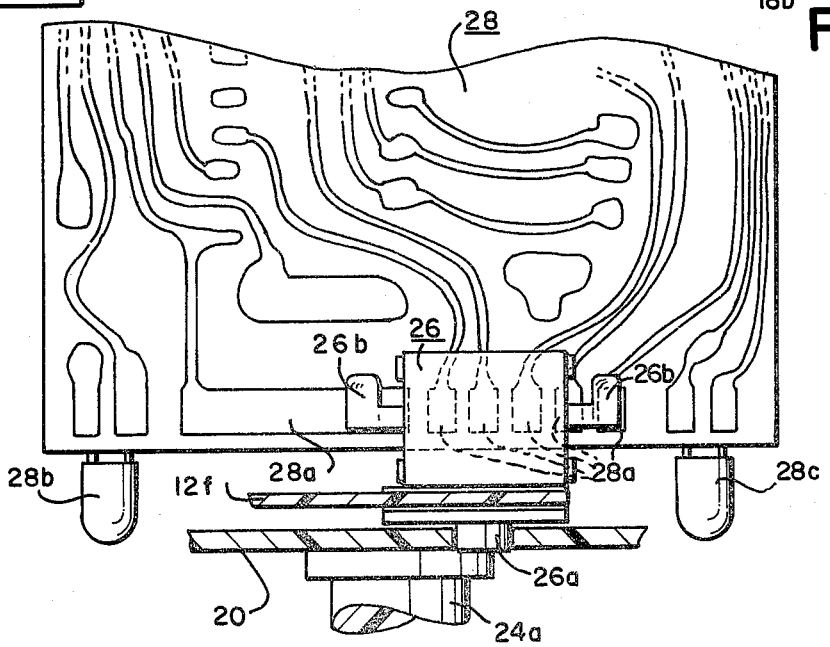
FIG. 10 is a fragmentary plan view, partly sectional, of some of the apparatus as shown in FIG. 8.

In accordance with a variation of the present invention as shown in FIGS. 11 and 12, the dial plate 16 may be equipped with a plurality of pairs of two small holes 16f associated with the main numerals on the dial. These holes, in cooperation with element 18, allow depiction of the position of the decimal point associated with the main numerals when the knob 15 is pulled outwardly and rotated to bring a different one of the range-indicating indicia 18c within the window 16c.

To change the position of the visible decimal point seen from the front of the timing apparatus, the plate 18 may be provided with white areas 18*d* which, when the plate 18 is rotated in response to the turning of the knob 15 in the pull-out or range-set position, are formed to appear behind certain predetermined ones of the holes 16*f*. Since the background of the dial is white, those holes will be effectively concealed. At the same time, black areas 18*e* will appear behind other ones of the holes and will appear, by contrast with the white background, as the decimal points. Thus, if the dial of the plate 16 is meant to cover the range of 0-0.3 seconds, the knob 15 is pulled outwardly and rotated so the range marking "SEC 1" appears in the window 16*c* and the white areas 18*d* are disposed behind the right ones of the holes 16*f* of each pair, the black areas 18*e* being located behind the left holes of 16*f*. When the knob is used to reset the range to the "SEC 2" range, the white areas appear behind the left ones of the pair of holes whereas black areas appear behind the right holes showing that the range is 0-3 seconds. Each corresponding clockwise movement of the knob 15 will, in turn, bring a different one of the indicia 18*c* in the window 16*c* providing additional respective ranges 0-30 seconds, 0-3 minutes and 0-30 minutes in the SEC 3, MIN 1 and MIN 2 ranges, respectively.

While the invention has been described in terms of a timer embodiment, its principles are equally applicable to other apparatus wherein a single knob, in a first axial position controls a first function when rotated and in a second axial position controls a second function.

What is claimed is:

1. Control apparatus comprising:

(a) first rotatable means adapted to be coupled to a first rotatable utilization apparatus, said means being coupled in a first pre-determined axial position to said first utilization apparatus for control thereof by rotation and, (b) second rotatable means coupled to second utilization apparatus but normally not coupled to said first rotatable means in said first axial position, said second means being adapted to be coupled to said first rotatable means when the latter is in a second predetermined axial position whereupon said first rotatable means rotates said second rotatable means which thereupon controls said second utilization apparatus.

2. The control apparatus according to claim 1 wherein said second utilization apparatus includes reciprocating means and wherein said second means is disposed and arranged to cause said reciprocating means to assume a plurality of positions as a function of the rotary position of said second rotatable means.

3. The control apparatus according to claim 2 wherein said second utilization apparatus includes an electrical circuit with which said reciprocating means is arranged to make contact at a plurality of predetermined discrete positions.

4. The control apparatus according to claim 1 wherein said first rotatable means in said first axial position thereof is disengaged from said second rotatable means and further wherein said second rotatable means engages said first rotatable means when the latter is in said second axial position.

5. The control apparatus according to claim 4 wherein said first rotatable means is caused to assume said second axial position by pulling on said first rotatable means relative to said second rotatable means or vice versa and wherein means are provided which normally urge said first rotatable means into said first axis position.

6. The control apparatus according to claim 5 wherein said first and second rotatable means and said urging means are substantially coaxially mounted.

7. The control apparatus according to claim 1 wherein means are associated with said second rotatable means for producing visible indicia corresponding to the rotary position of said second rotary rotatable means.

8. The control apparatus according to claim 1 wherein fixed detent means are provided which engage said second rotatable means thereby to permit the latter to assume only a predetermined number of discrete rotary positions.

9. The control apparatus according to claim 8 wherein said second rotatable means is provided with at least one set of fixed teeth and wherein said fixed detent means comprises a resilient tooth for engaging selected ones of said set.

10. The control apparatus according to claim 8 wherein said second rotatable means has two sets of teeth disposed opposite one another for respective engagement with said detent means at rotary positions depending on the rotary orientation of said second rotatable means.

11. The control apparatus according to claim 9 wherein means are provided to immobilize said second rotatable means when it has been rotated to a position in which a predetermined one of its teeth is engaged by said fixed detent means.

12. The control apparatus according to claim 9 wherein said resilient tooth is associated with a housing for said apparatus and wherein said second rotatable means is generally in the form of an annular plastic disc having said set of teeth formed in one portion of the edge thereof, said annular disc also having at least one slot formed therein which engages a protuberance on said reciprocating means, said reciprocating means being arranged to slide in a track formed in said housing member.

13. The control apparatus according to claim 12 wherein said annular disc member also has a crenelated central aperture and wherein said first rotatable means includes a plurality of substantially parallel surface projections adapted to enter and engage selected ones of said crenels substantially only when said first and second rotatable members are made to approach one another in a predetermined relative rotary relationship with one another.

14. The control apparatus according to claim 10 wherein said second rotatable means is provided with two slots disposed substantially opposite one another.

15. The control apparatus according to claim 12 wherein said second rotatable means also includes at least one notch formed in the edge thereof which is engaged by a protuberance formed in said housing thereby limiting the rotary movement of said second rotatable means relative to said housing.

16. The control apparatus according to claim 12 wherein said second rotatable means has two notches in the edge thereof opposite one another which are engageable by a protuberance formed in said housing thereby limiting the rotary movement of said second rotatable means relative to said housing.

17. The control apparatus according to claim 1 wherein said apparatus is timing apparatus, wherein said first utilization apparatus is a circuit for timing a predetermined cycle and wherein said second utilization apparatus comprises a plurality of selectable timing range circuits in which said timing apparatus is intended to operate.

18. The control apparatus according to claim 13 wherein the number of said parallel surface projections is a submultiple of the number of said crenels, thereby to facilitate entry of the former into the latter.

19. The control apparatus according to claim 11 wherein said immobilizing means includes a fixed planar member having a central aperture and a plurality of holes formed around said aperture, and said second rotatable means is also provided with holes around a central aperture which may be aligned with selected holes in said planar member, said immobilizing means also including rigid pin means adapted to be passed through selected aligned ones of the holes in said planar member and in said second rotatable means.

20. The control apparatus according to claim 14 wherein when one of said sets of teeth is disposed for engagement by said detent means, a selected one of said slots engages a protuberance on said reciprocating means and wherein, when said other set of teeth is disposed for engagement by said detent means, the other of said slots engages said protuberance on said reciprocating means.

21. Control apparatus according to claim 1 with the addition of indicating means and wherein said first utilization apparatus controls the length of a timing cycle and wherein said second utilization apparatus controls a plurality of ranges of timing cycles, and wherein said second rotatable means is adapted to cooperate with said first rotatable means to select one of said plurality of timing ranges and also to alter the visual presentation of said indicating means to correspond to the range chosen.

22. Control apparatus according to claim 21 wherein said indicating means includes a plurality of numerals and said corresponding altered visual presentation is a change in the decimal point associated with said numerals.

23. Control apparatus according to claim 21 wherein said indicating means has a plurality of sets of apertures respectively associated with said numerals and with the addition of third rotatable means arranged for rotation in unison with said second rotatable means, said third rotatable means having predetermined differently-colored areas for effectively masking predetermined ones of said apertures as a function of its rotary position.

24. Control apparatus according to claim 23 wherein said third rotatable means is disposed contiguous to and concentric with part of said second rotatable means.

* * * * *